US010100833B2

(12) United States Patent
Nishide

(10) Patent No.: US 10,100,833 B2
(45) Date of Patent: Oct. 16, 2018

(54) SCROLL COMPRESSOR

(71) Applicant: DAIKIN INDUSTRIES, LTD., Osaka-shi, Osaka (JP)

(72) Inventor: Youhei Nishide, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 160 days.

(21) Appl. No.: 15/100,911

(22) PCT Filed: Dec. 2, 2014

(86) PCT No.: PCT/JP2014/006007
§ 371 (c)(1),
(2) Date: Jun. 1, 2016

(87) PCT Pub. No.: WO2015/083369
PCT Pub. Date: Jun. 11, 2015

(65) Prior Publication Data

US 2016/0298626 A1 Oct. 13, 2016

(30) Foreign Application Priority Data

Dec. 2, 2013 (JP) ..... 2013-249363

(51) Int. Cl.
*F01C 1/02* (2006.01)
*F01C 1/063* (2006.01)
(Continued)

(52) U.S. Cl.
CPC ..... *F04C 18/0215* (2013.01); *F04C 18/0253* (2013.01); *F04C 27/005* (2013.01)

(58) Field of Classification Search
USPC ..... 418/55.1–55.6, 57, 270; 417/301, 307, 417/310
See application file for complete search history.

(56) References Cited

U.S. PATENT DOCUMENTS 4,669,962 A 6/1987 Mizuno et al.
6,389,837 B1 * 5/2002 Morozumi ..... F04C 23/008 418/55.5
(Continued)

FOREIGN PATENT DOCUMENTS

CN 102472273 A 5/2012
EP 2 312 164 A1 4/2011
(Continued)

OTHER PUBLICATIONS

European Search Report of corresponding EP Application No. 14 86 7598.6 dated Aug. 23, 2017.
(Continued)

*Primary Examiner* — Mark Laurenzi
*Assistant Examiner* — Deming Wan
(74) *Attorney, Agent, or Firm* — Global IP Counselors, LLP

(57) ABSTRACT

A scroll compressor includes a compression mechanism having fixed and movable scrolls defining a compression chamber, an introduction mechanism, and an auxiliary introduction mechanism. The introduction mechanism supplies fluid from the compression chamber to a back-pressure chamber supply throughout a first period. The auxiliary introduction mechanism has an auxiliary introduction passage and a check valve. The auxiliary introduction mechanism supplies fluid from the compression chamber to a back-pressure chamber supply throughout a second period. The second period includes a time point prior to the first period.

7 Claims, 7 Drawing Sheets

(51) Int. Cl.

| | |
|---|---|
| ***F03C 2/24*** | (2006.01) |
| ***F04C 2/02*** | (2006.01) |
| ***F04C 18/02*** | (2006.01) |
| ***F04B 49/24*** | (2006.01) |
| ***F04C 27/00*** | (2006.01) |

(56) References Cited

U.S. PATENT DOCUMENTS

| | | | | |
|---|---|---|---|---|
| 7,442,017 | B2 * | 10/2008 | Tsuchiya | F04C 23/008<br>417/308 |
| 2012/0164014 | A1 * | 6/2012 | Nagahara | F04C 18/0215<br>418/55.1 |
| 2013/0061700 | A1 | 3/2013 | Mitsui et al. | |

FOREIGN PATENT DOCUMENTS

| | | | |
|---|---|---|---|
| EP | 2 474 740 | A1 | 7/2012 |
| EP | 2 639 457 | A1 | 9/2013 |
| JP | 61-53486 | A | 3/1986 |
| JP | 64-44385 | U | 3/1989 |
| JP | 3-134285 | A | 6/1991 |
| JP | 2011-52603 | A | 3/2011 |
| JP | 2011-244123 | A | 12/2011 |

OTHER PUBLICATIONS

International Search Report of corresponding PCT Application No. PCT/JP2014/006007 dated Feb. 24, 2015.
International Preliminary Report of corresponding PCT Application No. PCT/JP2014/006007 dated Jun. 16, 2016.

* cited by examiner

SCROLL COMPRESSOR

CROSS-REFERENCE TO RELATED APPLICATIONS

This U.S. National stage application claims priority under 35 U.S.C. § 119(a) to Japanese Patent Application No. 2013-249363, filed in Japan on Dec. 2, 2013, the entire contents of which are hereby incorporated herein by reference.

TECHNICAL FIELD

The present invention relates to a scroll compressor and, more particularly, to a counter measure to a tilt of an orbiting scroll.

BACKGROUND ART

Scroll compressors known in the arts include a compression mechanism having a fixed scroll, an orbiting scroll, and a compression chamber defined between the fixed and orbiting scrolls.

Japanese Unexamined Patent Publication No. 2011-24412.3 discloses one of such scroll compressors. This scroll compressor includes a compression mechanism having an introduction passage defined to supply a fluid, in the middle of compression in a compression chamber, to a back-pressure chamber provided in back of an orbiting scroll. This introduction passage intermittently supplies a refrigerant under an intermediate pressure toward the back-pressure chamber. The supply of the refrigerant creates pressing force to be applied to the orbiting scroll in a direction opposite to a thrust direction of the load of gas in the compression chamber, thereby reducing the tilt of the orbiting scroll.

SUMMARY

Technical Problem

If an orbiting scroll of a scroll compressor once tilts because of the fall of a high-low differential pressure of a fluid when the scroll compressor starts to operate or changes its operations, removing the tilt of the orbiting scroll could be difficult even if the fallen high-low differential pressure of the fluid returns to a normal differential pressure. Described below are two major reasons why removing the tilt is difficult.

First, if the orbiting scroll once tilts, such a tilt widens the gap of a thrust surface between the fixed scroll and the orbiting scroll. As a result, even if the fluid in the compression chamber is supplied to the back-pressure chamber, as described in Japanese examined Patent Publication No. 2011-244123, the fluid in this back-pressure chamber can leak through the gap into the suction side (a low-pressure side) of the compression mechanism. Specifically, if the gap of the thrust surface between the two scrolls becomes greater with the tilt of the orbiting scroll, the fluid leaking from the back-pressure chamber into the suction side of the compression mechanism can be higher in flow rate than a fluid supplied from the introduction passage to the back-pressure chamber. As a result, even if the high-low differential pressure returns to the normal differential pressure as described above, it will take excessive time to raise the pressure of the back-pressure chamber. This makes it difficult to remove the tilt of the orbiting scroll.

Second, if the orbiting scroll once tilts, the tilt tends to create a gap between end faces of the wraps of both of the scrolls and the end plates facing the respective wraps. Hence, in the compression chamber, a relatively high-pressure fluid near a discharge port can leak toward the suction port through this gap. Then, in the compression chamber, the fluid under the relatively high pressure can be excessively compressed, and the internal pressure of the compression chamber rises higher than that during a normal operation. The rise in the internal pressure of the compression chamber creates greater force to separate the orbiting scroll from the fixed scroll, which makes it difficult to remove the tilt of the orbiting scroll.

The above reasons pose a problem; that is, if the orbiting scroll once tilts, it will take excessive time to remove such a tilt and to return to the normal operation.

In view of the forgoing background, it is therefore an object of the present invention to provide a scroll compressor which may quickly remove a tilt of an orbiting scroll.

Solution to the Problem

A first aspect of the present disclosure is directed to a scroll compressor comprising a compression mechanism (30) including a fixed scroll (40), an orbiting scroll (35), and a compression chamber (31) defined between the fixed scroll (40) and the orbiting scroll (35), wherein the compression mechanism (30) includes (i) an introduction mechanism (70) having an introduction passage (71, 72) which provides communication between the compression chamber (31) and a back-pressure chamber (56), the introduction mechanism (70) being configured to supply, throughout a first period, a fluid of the compression chamber (31) to a back-pressure chamber (56) in back of the orbiting scroll (35), and (ii) an auxiliary introduction mechanism (80) having: an auxiliary introduction passage (81) which provides communication between the compression chamber (31) and the back-pressure chamber (56); and a check valve (82) which allows the fluid to flow from the compression chamber (31) to the back-pressure chamber (56), and blocks the fluid from flowing from the back-pressure chamber (56) toward the compression chamber (31), the auxiliary introduction mechanism (80) being configured to supply, throughout a second period, the fluid of the compression chamber (31) to the back-pressure chamber (56), and the second period including a time point prior to the first period.

The compression mechanism (30) according to the first aspect includes the introduction mechanism (70) and the auxiliary introduction mechanism (80). When a scroll compressor is in a normal operation, the fluid of the compression chamber (31) is supplied through the introduction passage (71, 72) to the back-pressure chamber (56). As a result, the pressure of the back-pressure chamber (56) rises. Even if the pressure of the back-pressure chamber (56) rises relatively high, the check valve (82) blocks the fluid of the back-pressure chamber (56) from back-flowing through an auxiliary introduction passage (81) to the compression chamber (31). Such features allow for maintaining the pressure of the back-pressure chamber (56) at a target value in the normal operation, contributing to reducing a tilt of the orbiting scroll (35).

Meanwhile, if the pressure of the back-pressure chamber (56) falls and the orbiting scroll (35) once tilts when the scroll compressor (10) starts to operate or changes its operations, a typical scroll compressor could not quickly remove the tilt of the orbiting scroll (35) as described above. To the contrary, in the present invention, when the orbiting scroll (35) tilts and the pressure of the back-pressure chamber (56) falls, and the pressure of the compression chamber (31) communicating with the auxiliary introduction passage (81) rises higher than that of the back-pressure chamber (56), the check valve (82) is opened and the fluid of the compression chamber (31) is supplied through the auxiliary introduction passage (81) to the back-pressure chamber (56). The auxiliary introduction mechanism (80) supplies the fluid to the back-pressure chamber (56) before the introduction mechanism (70) does, which encourages the pressure of the back-pressure chamber (56) to rise. Specifically, since the auxiliary introduction mechanism (80) and the introduction mechanism (70) continuously supply the fluid to the back-pressure chamber (56), the pressure of the back-pressure chamber (56) quickly rises. As a result, the orbiting scroll (35) may receive sufficient pressing force, which makes it easy to remove the tilt of the orbiting scroll (35).

Moreover, supplying the fluid of the compression chamber (31) to the back-pressure chamber (56) as described above may reduce the rise in the pressure of the compression chamber (31). This contributes to reducing force to separate the orbiting scroll (35), and easily removing the tilt of the orbiting scroll (35).

In a second aspect of the present disclosure according to the first aspect, the auxiliary introduction mechanism (80) is configured to overlap a part of the second period with a part of the first period.

In the second aspect, when the orbiting scroll (35) once tilts and the pressure of the back-pressure chamber (56) falls, the auxiliary introduction mechanism (80) first supplies the fluid to the back-pressure chamber (56) throughout the second period. In the present invention, a part of the second period overlaps with a part of the first period. Here, in the first period, the introduction mechanism (70) supplies the fluid to the back-pressure chamber (56). This overlap allows the auxiliary introduction mechanism (80) to supply a fluid under a relatively high pressure to the back-pressure chamber (56) throughout a relatively long period. As a result, the pressure of the back-pressure chamber (56) may quickly rise, which contributes to immediately removing the tilt of the orbiting scroll (35).

In a third aspect of the present disclosure according to one of the first aspect or the second aspect, in the compression chamber (31), an inflow end of the auxiliary introduction passage (81) is opened closer to a low-pressure side of the compression chamber (31) than an inflow end of the introduction passage (72) is.

In a fourth aspect of the present disclosure according to any one of the first aspect to the third aspect, the introduction passage includes a movable vertical hole (71) penetrating a movable end plate part (36) of the orbiting scroll (35) and communicating with the back-pressure chamber (56), and a fixed communication groove (72) defined on a rim (43) of the fixed scroll (40) and communicating with the compression chamber (31), the fixed communication groove (72) and the movable vertical hole (71) intermittently communicating with each other with rotation of the orbiting scroll (35), and the auxiliary introduction mechanism (80) is configured to finish the second period before an opening area of the movable vertical hole (71) with respect to the fixed communication groove (72) increases to a maximum.

Advantages of the Invention

According to the present disclosure, even if the orbiting scroll (35) tilts when the compressor (10) starts to operate or changes its operations, the auxiliary introduction mechanism (80) supplies the fluid of the compression chamber (31) to the back-pressure chamber (56) before the introduction mechanism (70) does. Such a feature allows the pressure of the back-pressure chamber (56) to quickly rise. As a result, the tilt of the orbiting scroll (35) may be quickly removed, and the compressor (10) may return to a normal operation.

Furthermore, according to the second aspect of the present disclosure, a part of the second period overlaps with a part of the first period. Here, in the second period, the auxiliary introduction mechanism (80) supplies the fluid to the middle-pressure back-pressure chamber (56), and, in the first period, the introduction mechanism (70) supplies the fluid to the middle-pressure back-pressure chamber (56). Such an overlap allows for supplying a fluid under a relatively high pressure to the back-pressure chamber (56). As a result, the tilt of the orbiting scroll (35) may be remove more quickly.

DESCRIPTION OF EMBODIMENTS

Embodiments of the present disclosure will now be described, with reference to the drawings. Note that the embodiments below are merely examples in nature and are not intended to limit the scope, application or use of the present disclosure.

A compressor (10) according to the embodiments is a scroll compressor, and connected to a refrigerant circuit of, for example, a refrigerating apparatus. This refrigerant circuit allows a refrigerant, compressed by the compressor (10), to circulate therein so that a vapor-compression refrigeration cycle is conducted.

Figure 1:
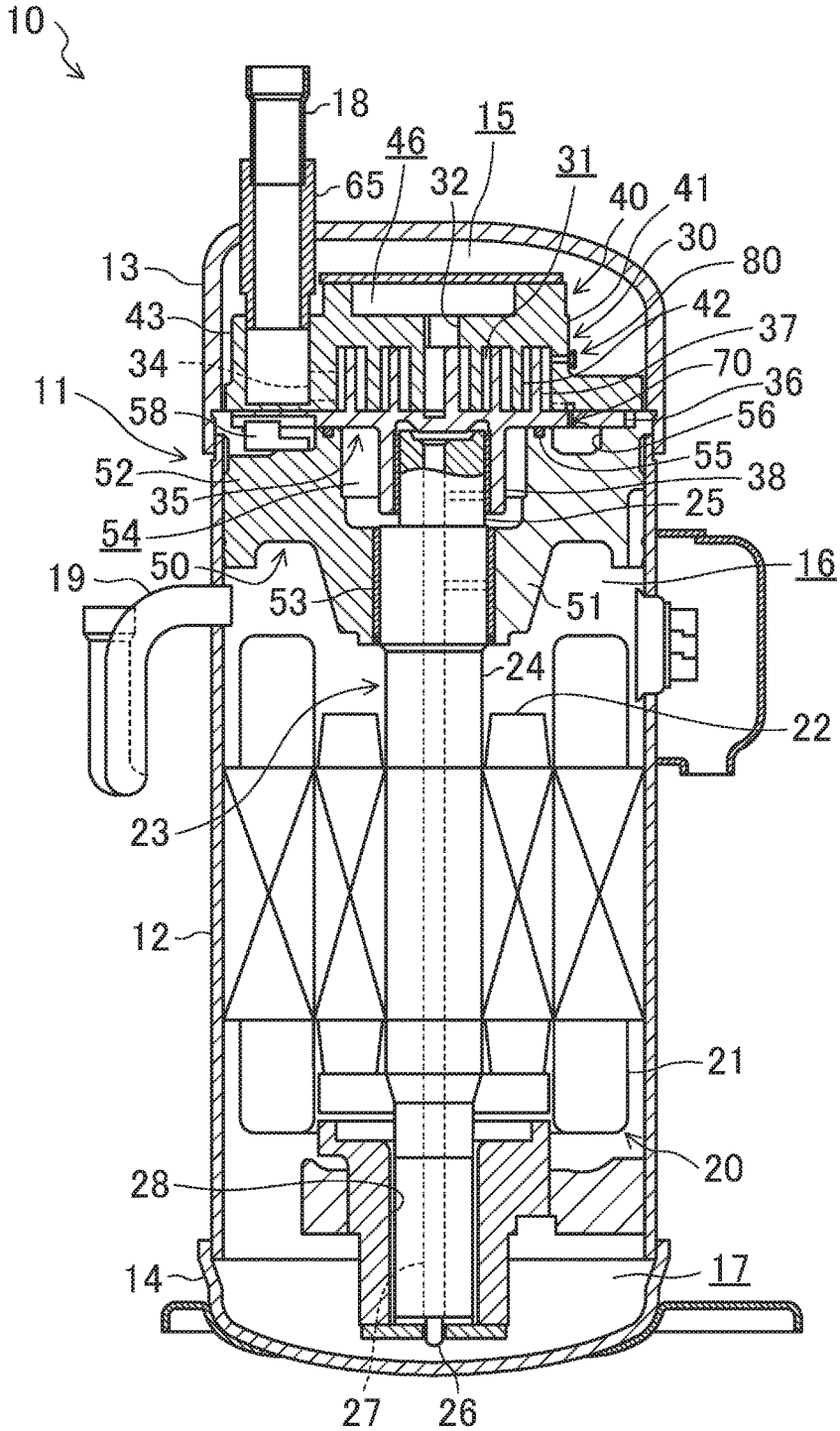
FIG. 1 is a longitudinal cross-sectional view illustrating an overall configuration of a scroll compressor according to embodiments.

As illustrated in FIG. 1, the compressor (10) includes a casing (11), a motor (20), and a compression mechanism (30). The casing (11) contains the motor (20) and the compression mechanism (30). The casing (11) is a closed container shaped in a form of an oblong cylinder. The casing (11) includes: a body (12) cylindrically shaped and having both axial ends opened; an upper end plate (13) closing an upper end portion of the body (12); and a lower end plate (14) closing a lower end portion of the body (12). An interior space of the casing (11) is vertically compartmentalized by a housing (50). In the casing (11), a space above the housing (50) defines an upper space (15), and a space below the housing (50) defines a lower space (16). Moreover, in the lower space (16), an oil storage (17) is formed on the bottom of the casing (11). The oil storage (17) stores lubricant for lubricating the compression mechanism (30) and the sliding parts of a beating.

A suction pipe (18) and a discharge pipe (19) are attached to the casing 11). The suction pipe (18) penetrates an upper portion of the upper end plate (13). An outflow end of the suction pipe (18) is connected to a suction pipe coupling (65) of the compression mechanism (30). The suction pipe (19) penetrates the body (12). An inflow end portion of the suction pipe (19) is opened to the lower space (16).

The suction pipe (20) is housed in the lower space (16). The motor (20) includes a stator (21) and a rotor (22). The stator (21) is cylindrically shaped, and an outer periphery of the stator (21) is secured to the body (12) of the casing (11). The rotor (22) is cylindrically shaped, and inserted into the stator (21). Secured in the rotor (22) is a drive shaft (23) which penetrates this rotor (22).

The drive shaft (23) connects the motor (20) and the compression mechanism (30). The drive shaft (23) includes a main shaft (24), and an eccentric portion (25) integrally formed above the main shaft (24). The eccentric portion (25) is smaller in diameter than the main shaft (24), and is offset at a predetermined eccentricity with respect to a shaft center of the main shaft (24). The main shaft (24) is rotatably supported by a lower bearing (28) and an upper bearing (53). A lower end portion of the drive shaft (23) is provided with an oil-feed pump (26). A suction port of the oil-feed pump (26) is opened to the oil storage (17). The lubricant pumped by the oil-feed pump (26) is supplied through an oil-feed passage (27) in the drive shaft (23) to the compression mechanism (30) and sliding parts of the bearings (28, 53).

The housing (50) is secured to the upper end portion of the body (12) of the casing (11). The housing (50) is shaped generally cylindrically, and has the main shaft (24) penetrate an interior of the housing (50). The housing (50) includes a small diameter part (51) formed around the upper bearing (53), and a large diameter part (52) formed around the eccentric portion (25). An outer periphery of the large diameter part (52) is secured to the casing (11). Defined in the large diameter part (52) is a high-pressure back-pressure chamber (54) shaped generally cylindrically. This high-pressure back-pressure chamber (54) is supplied with high-pressure lubricant flowing from the oil-feed passage (27). The high-pressure back-pressure chamber (54) is the same in ambient pressure as a refrigerant discharged from the compression mechanism (30). Furthermore, the large diameter part (52) of the housing (50) is provided with a seal ring (55) annularly shaped and placed on a top end of an inner peripheral portion of the large diameter part (52). The seal ring (55) provides an airtight separation between the high-pressure back-pressure chamber (54) and a middle-pressure back-pressure chamber (56). The high-pressure back-pressure chamber (54) is defined in the inner periphery of the seal ring (55), and the middle-pressure back-pressure chamber (56) is located to the outer periphery of the seal ring (55).

The compression mechanism (30) is placed above the housing (50). The compression mechanism (30) is a scroll-type rotating compression mechanism including a fixed scroll (40) and an orbiting scroll (35). In the compression mechanism (30), the fixed scroll (40) and the orbiting scroll (35) has a compression chamber (31) defined therebetween. The fixed scroll (40) is bolted on the housing (50), and the orbiting scroll (35) is rotatably housed between the fixed scroll (40) and the housing (50).

The fixed scroll (40) includes a fixed end plate part (41) shaped into a generally circular disk, a fixed wrap (42) supported by a lower surface of the fixed end plate part (41), and a rim (43) formed radially outside the fixed wrap (42).

Figure 3:
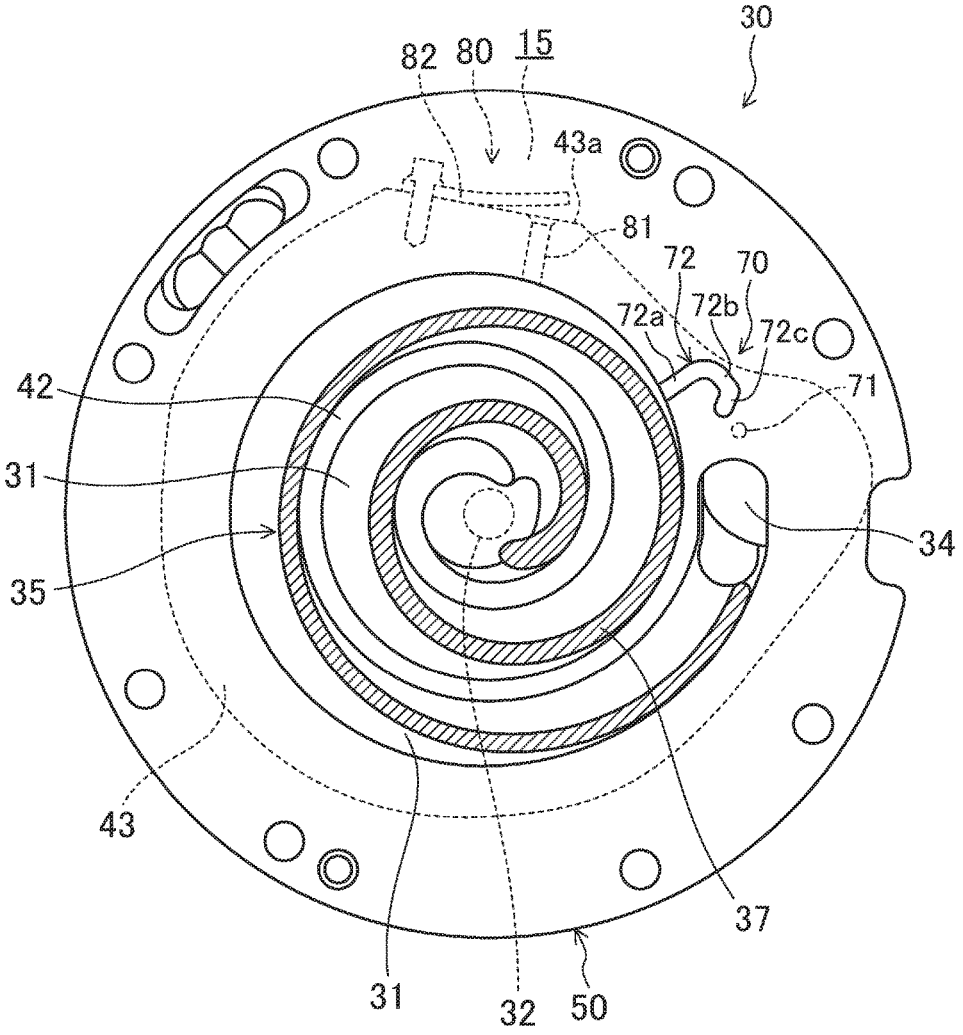
FIG. 3 is a transverse cross-sectional view showing, from below, a fixed scroll according to the embodiments at a time point when a compression phase of an outermost compression chamber starts.

On a center of the fixed end plate part (41), a discharge port (32) is formed. The discharge port (32) vertically penetrates the fixed end plate part (41). Above the discharge port (32), a discharge chamber (46) is located. The discharge chamber (46) is in communication with the lower space (16) through a not-shown discharge flow passage. Specifically, the lower space (16) is the same in ambient pressure as a refrigerant discharged from the compression mechanism (30). The fixed wrap (42) is formed by spirally extending from the discharge port (32) toward the rip portion (43) (see FIG. 3). On the rim (43) of the fixed scroll (40), a suction port (34) is formed. The suction pipe (34) connects to an outflow portion of the suction pipe (18).

The orbiting scroll (35) includes a movable end plate part (36) shaped into a generally circular disk, a movable wrap (37) supported by an upper surface of the movable end plate part (36), and a boss (38) supported by the lower surface of the movable end plate part (36). The movable end plate part (36) is supported by the housing (50) through an Oldham's coupling (58). The movable wrap (37) is formed by spirally extending near a center of the movable end plate part (36) toward the rim (43) of the fixed scroll (40). The boss (38) is shaped into a cylinder of which bottom is open, and has the eccentric portion (25) inserted thereinto.

On a top end face of the large diameter part (52) of the housing (50), a generally annular recess is defined. In this recess, the middle-pressure back-pressure chamber (56) is defined. This middle-pressure back-pressure chamber (56) is supplied with the refrigerant, of the compression chamber (31), under intermediate pressure. Moreover, the middle-pressure back-pressure chamber (56) is in communication with the upper space (15) through a not-shown communication passage. Specifically, the middle-pressure back-pressure chamber (56) is substantially the same in ambient pressure as the upper space (15).

The compression mechanism (30) according to the embodiments is provided with an introduction mechanism (70) and an auxiliary introduction mechanism (80) both of which supply the refrigerant of the compression chamber (31) to the middle-pressure back-pressure chamber (56). The introduction mechanism (70) and the auxiliary introduction mechanism (80) will be described in detail with reference to FIGS. 2 and 3.

The introduction mechanism (70) includes a movable vertical hole (71) and a fixed communication groove (72). The movable vertical hole (71) is a through hole axially penetrating the movable end plate part (36) of the orbiting scroll (35). The movable vertical hole (71) is defined in a form of an elongated cylinder. When the orbiting scroll (35) rotates, the movable vertical hole (71) is displaced in a turning radius substantially equal to that of the orbiting scroll (35). An orbit of the movable vertical hole (71) axially overlaps with the middle-pressure back-pressure chamber (56). In other words, the movable vertical hole (71) is always in communication with the middle-pressure back-pressure chamber (56) no matter where the movable vertical hole (71) is positioned during the rotation.

The fixed communication groove (72) is defined on the lower surface (i.e., a thrust surface) of the rim (43) of the fixed scroll (40). An inflow end of the fixed communication groove (72) is opened to an inner peripheral surface of the rim (43). The fixed communication groove (72) has an outflow end defined at a position at which the communication between the outflow end and the movable vertical hole (71) is opened and closed. More specifically, the fixed communication groove (72) includes an inflow groove portion (72*a*), an intermediate groove portion 72*b*), and an outflow groove portion (72*a*) continuously and integrally formed with one another. The inflow groove portion (72*a*) extends radially outwardly from the inner peripheral surface of the rim (43). The intermediate groove portion (72*b*) bends at radially outward end portion of the inflow groove portion (72*a*) and circumferentially extends. The outflow groove portion (72*c*) bends radially inwardly at an outflow of the intermediate groove portion (72*b*), and the outflow end of the outflow groove portion (72*c*) overlaps with the orbit of the movable vertical hole (71).

In the introduction mechanism (70), the fixed communication groove (72) and the movable vertical hole (71) intermittently communicate with each other, with the rotation of the orbiting scroll (35). The communication between the fixed communication groove (72) and the movable vertical hole (71) in the introduction mechanism (70) defines an introduction passage which provides communication between an outermost compression chamber (31) and the middle-pressure back-pressure chamber (56). Throughout a first period (details will be described later), the introduction mechanism (70) supplies, via the introduction passages (71, 72), the middle-pressure back-pressure chamber (56) with the refrigerant, in the compression chamber (31), under intermediate pressure in the middle of compression.

The auxiliary introduction mechanism (80) includes a fixed communication hole (81) acting as an auxiliary introduction passage, and an opening and closing mechanism (a check valve (82)) to open and close the fixed communication hole (81).

Figure 2:
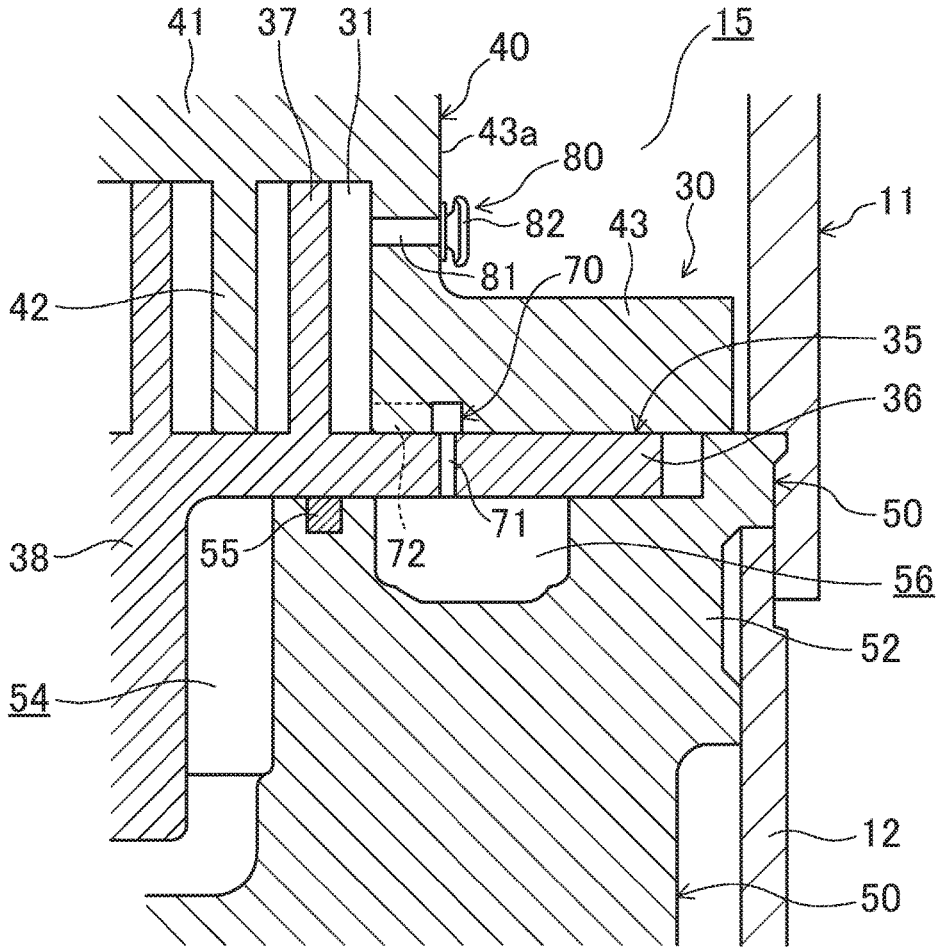
FIG. 2 is a longitudinal cross-sectional view magnifying an introduction mechanism and an auxiliary introduction mechanism according to the embodiments.

The fixed communication hole (81) is defined on a peripheral wall portion (43*a*). As illustrated in FIG. 2, the peripheral wall portion (43*a*) is included in the rim (43) of the fixed scroll (40), and formed near the fixed end plate part (41). The fixed communication hole (81) radially penetrates the peripheral wall portion (43*a*), and provides communication between the outermost compression chamber (31) and the upper space (15). On an interior wall surface of the rim (43) of the fixed scroll (40), the inflow end of the fixed communication hole (81) is located closer to the suction port (34) than that of the fixed communication groove (72) is. Specifically, the fixed communication hole (81) defines an introduction passage closer to the low-pressure side (the suction side) than the fixed communication groove (72) is.

The check valve (82) is provided to the outflow portion of the fixed communication hole 81). While allowing the refrigerant to flow from the compression chamber (31) to the upper space (15), the check valve (82) blocks the refrigerant from flowing from the upper space (15) to the compression chamber (31). Moreover, the check valve (82) is a reed valve to be opened, depending on a differential pressure between the compression chamber (31) and the upper space (15).

In the auxiliary introduction mechanism (80), the middle-pressure back-pressure chamber (56) and, eventually, the upper space (15) experience a pressure drop. When the differential pressure between the compression chamber (31) and the upper space (15) exceeds a predetermined pressure, the check valve (82) is opened. As a result, the refrigerant of the compression chamber (31) is introduced through the fixed communication hole (81) and the upper space (15) into the middle-pressure back-pressure chamber (56). Throughout a second period, which includes a time point prior to a period (the first period) in which the introduction mechanism (70) supplies the refrigerant to the middle-pressure back-pressure chamber (56), the auxiliary introduction mechanism (80) supplies the refrigerant of the compression chamber (31) to the middle-pressure back-pressure chamber (56) (details will be described later).

Driving Operation

Described next is a basic driving operation of the above compressor (10). Explained first is an operation of the compressor (10) in a normal operation.

When power is distributed to the motor (20) of the compressor (10), the drive shaft (23) rotates along with the rotor (22). As a result, the orbiting scroll (35) eccentrically rotates about the shaft center of the drive shaft (23), so that a volume of the compression chamber (31) changes periodically.

Specifically, when the orbiting scroll (35) rotates, the refrigerant is gradually sucked from the suction port (34) to an outermost fluid chamber. After that, this fluid chamber is completely closed so that the compression chamber (31) is defined (see FIG. 3), Furthermore, when the drive shaft (23) rotates, the volume of the outermost compression chamber (31) decreases, and the compression chamber (31) gradually moves closer to the discharge port (32).

Figure 5:
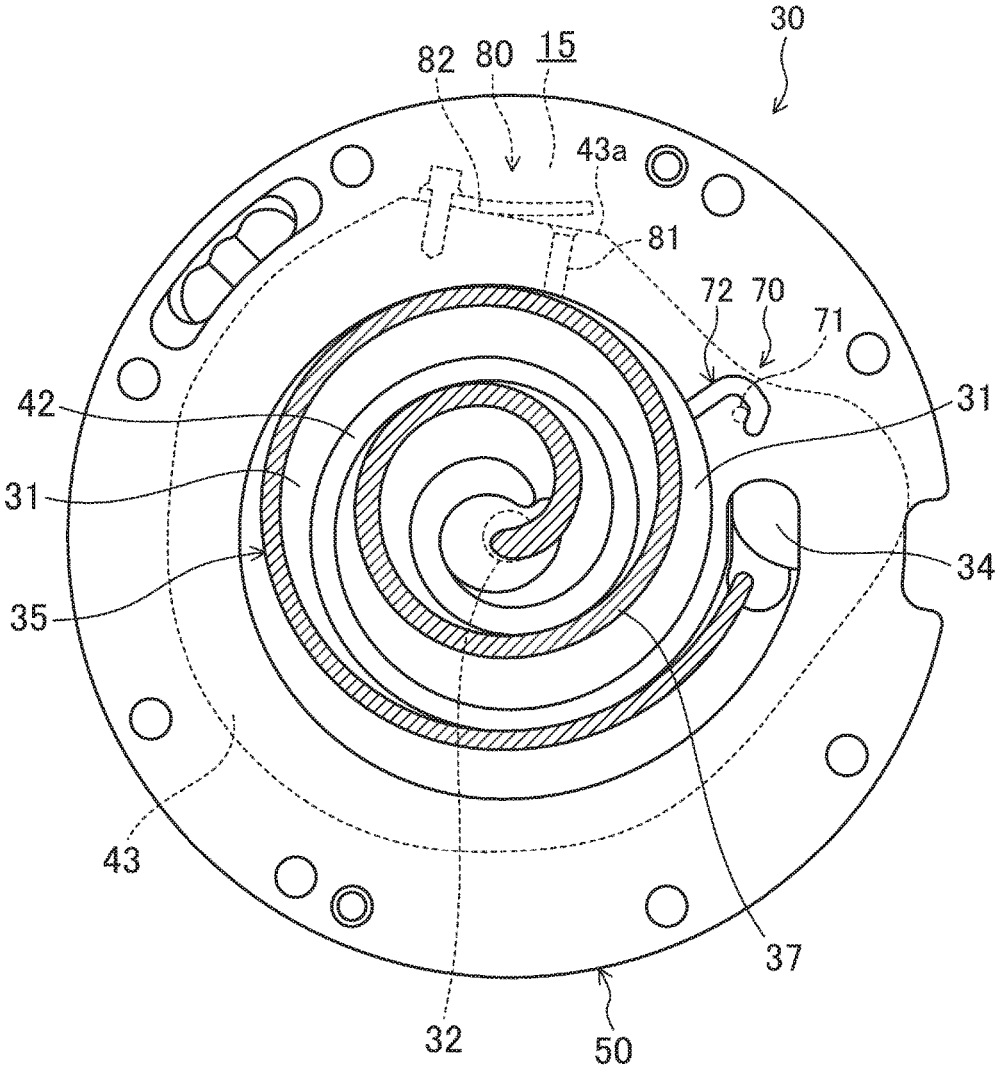
FIG. 5 is a transverse cross-sectional view showing, from below, the fixed scroll according to the embodiments at a time point (an angle of rotation=θ2) when communication starts between a fixed communication groove and a movable vertical hole.

Meanwhile, when the orbiting scroll (35) further rotates as illustrated in FIG. 5, the movable vertical hole (71) and fixed communication groove (72) communicate with each other. This communication allows the refrigerant, of the compression chamber (31), in the middle of compression to pass through the fixed communication hole (72) and the upper space (71) in the stated order, and to be introduced into the middle-pressure back-pressure chamber (56). When the orbiting scroll (35) further rotates in this state, an opening area of the movable vertical hole (71) with respect to the fixed communication groove (72) increases to a maximum in the introduction mechanism (70) (see FIG. 6). As a result, the middle-pressure back-pressure chamber (56) is maintained under a target pressure (hereinafter referred to as a target back pressure). When the back pressure of the middle-pressure back-pressure chamber (56) reaches the target back pressure, desired pressing force is applied to the movable end plate part (36) of the orbiting scroll (35). As a result, the orbiting scroll (35) is pressed toward the fixed scroll (40), reducing the tilt of the orbiting scroll (35).

Figure 6:
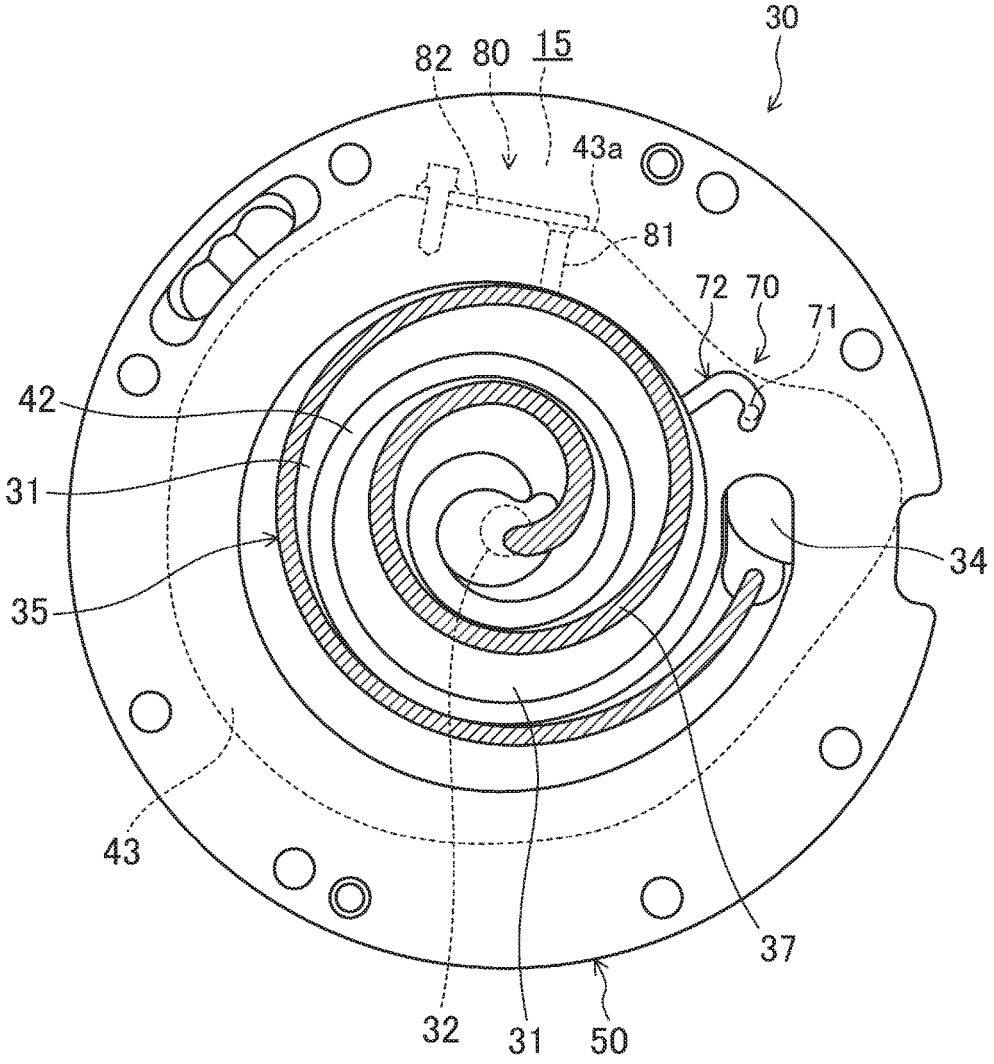
FIG. 6 is a transverse cross-sectional view showing, from below, the fixed scroll according to the embodiments at a time point (an angle of rotation=θ4) when an opening area of the movable vertical hole with respect to the fixed communication groove increases to a maximum.
Figure 7:
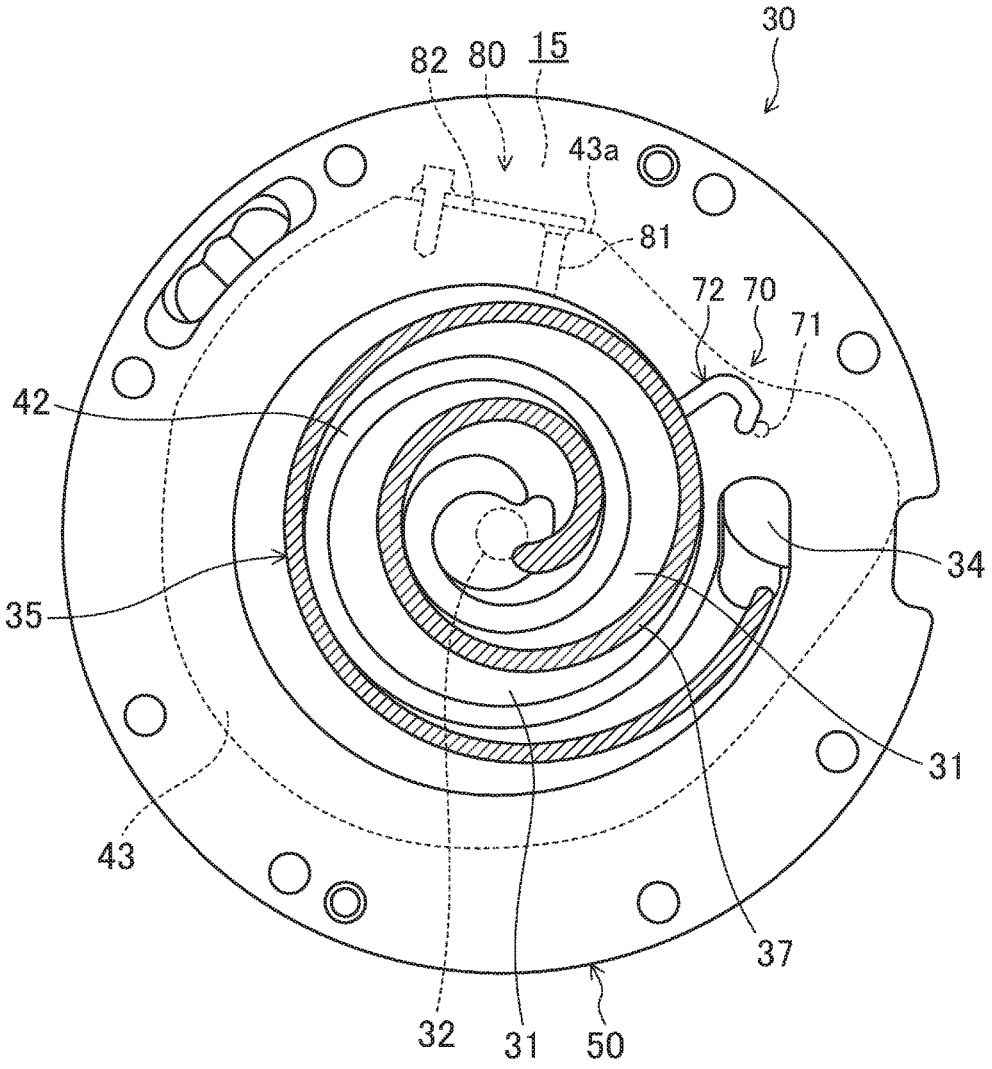
FIG. 7 is a transverse cross-sectional view showing, from below, the fixed scroll according to the embodiments at a time point (an angle of rotation=θ5) when communication ends between the fixed communication groove and the movable vertical hole.

When the orbiting scroll (35) further rotates in the state of FIG. 6, the fixed communication groove (72) and the movable vertical hole (71) are isolated from each other (see FIG. 7). As a result, the introduction mechanism (70) finishes the operation to introduce the refrigerant to the middle-pressure back-pressure chamber (56). When the orbiting scroll (35) further rotates in this state, the compression chamber (31) near the center communicates with the discharge port (32). As a result, the refrigerant compressed by the compression chamber (31) is discharged from the discharge port (32) to the discharge chamber (46), This refrigerant flows through the lower space (16) of the casing (11) out of the discharge pipe (19) to be used for a refrigeration cycle.

Such a normal driving operation of the compressor (10) does not involve the activation of the auxiliary introduction mechanism (80). This is because the check valve (82) of the fixed communication hole (81) is left closed when the middle-pressure back-pressure chamber (56) is maintained under the target pressure as described above. Accordingly, in such a normal operation, the refrigerant of the compression chamber (31) is not supplied through the auxiliary introduction passage (the fixed communication hole (81)) to the upper space (15).

Operation of Auxiliary Introduction Mechanism

If for example, the high-low differential pressure of the refrigerant circuit falls and the orbiting scroll (35) once tilts when the compressor (10) starts to operate or changes its operations, a typical compressor poses a problem that the tilt of the orbiting scroll (35) cannot be removed quickly even if the high-low differential pressure rises after the tilt.

Specifically, the tilt of the orbiting scroll (35) can create a relatively wide gap of the thrust surface between the movable end plate part (36) of the orbiting scroll (35) and the rim (43) of the fixed scroll (40). Then, the refrigerant, of the middle-pressure back-pressure chamber (56), under the intermediate pressure can leak through this gap into the suction side (the low-pressure side) of the compression chamber (31). As a result, as illustrated in FIG. 4, a pressure Pu of the middle-pressure back-pressure chamber (56) falls significantly below an original target pressure Po, so that desired pressing force could not be applied to the orbiting scroll (35).

Moreover, the tilt of the orbiting scroll (35) can create a relatively wide gap between a tip of the fixed wrap (42) and the movable end plate part (36), and between a tip of the movable wrap (37) and the fixed end plate part (41). Hence, the refrigerant under a relatively high pressure toward the discharge port (32) can leak through this gap into the compression chamber (31) toward the suction port. This refrigerant can be compressed again to have an excessive pressure. As a result, as illustrated in a broken line of FIG. 4, the internal pressure of the compression chamber rises higher in total than that in the normal operation. Such a pressure rise can increase the load of gas, and cause the increased load to create greater force to separate the orbiting scroll (35) from the fixed scroll (40).

As can be seen, the lack of the pressing force by the orbiting scroll (35) and the excessive separation force of the orbiting scroll (35) pose problems that it takes excessive time to bring the tilted orbiting scroll (35) back to its original state, which decreases the reliability of the compressor (10). Thus, when the compressor (10) starts to operate or changes its operations, these embodiments allow the auxiliary introduction mechanism (80) to operate to quickly remove the tilt of the orbiting scroll (35).

Figure 4:
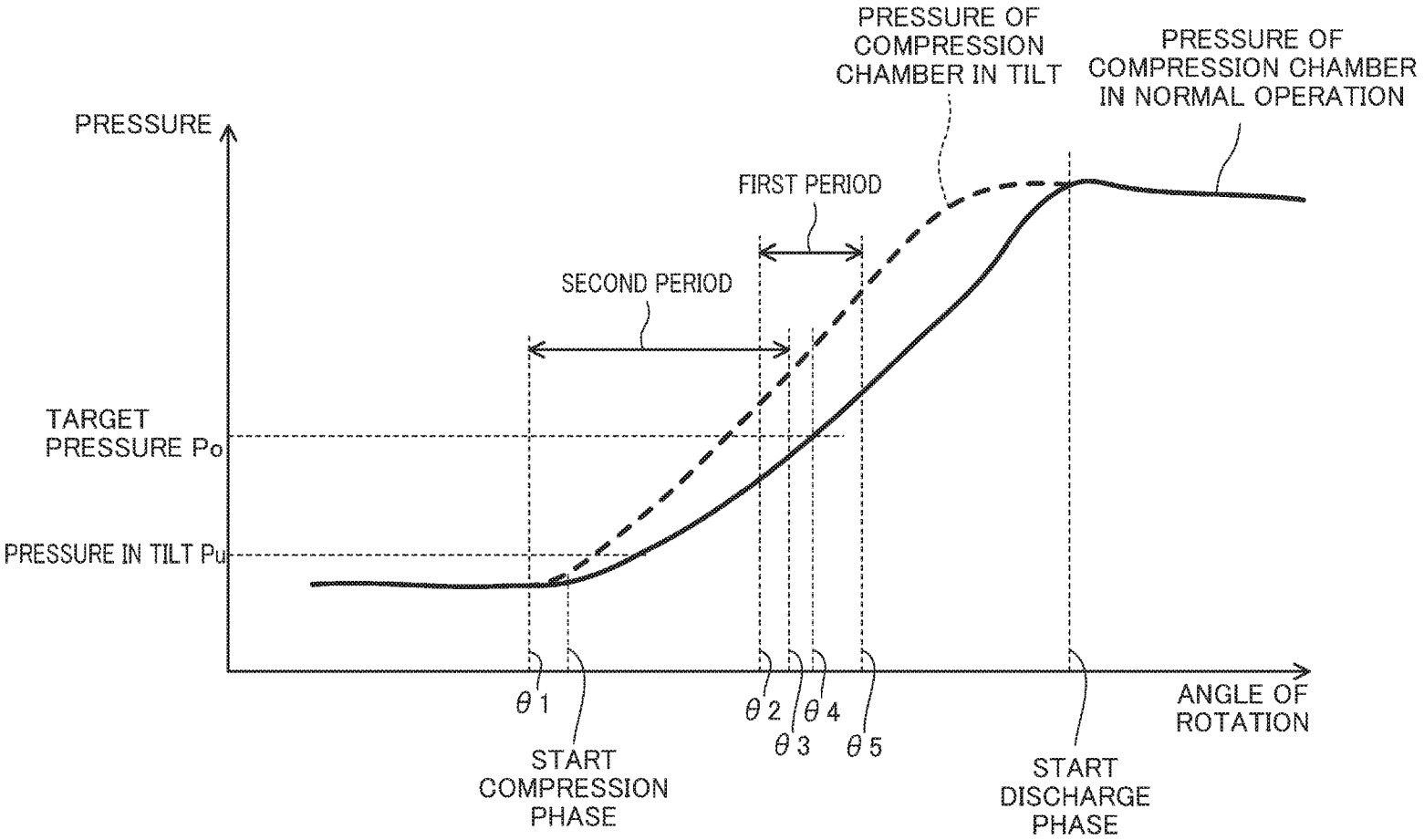
FIG. 4 is a graph showing a change in internal pressure of a compression chamber in a compression mechanism according to the embodiments.

The fixed communication hole (81) according to these embodiments is defined and positioned to be left open to the outermost fluid chamber throughout the second period illustrated in FIG. 4. Specifically, an inflow port of the fixed communication hole (81) is provided to open to a fluid chamber in the compression mechanism (30) when the angle of rotation of the orbiting scroll (35) ranges from θ1 to θ3. Here, the angle of rotation θ1 is slightly smaller than an angle of rotation corresponding to a time point when a compression phase of the outermost compression chamber (31) starts. Furthermore, the angle of rotation θ3 is subsequent to a time point (the angle of rotation θ2) when the introduction mechanism (70) starts the communication between the compression chamber (31) and the middle-pressure back-pressure chamber (56). Moreover, the angle of rotation θ3 is slightly prior to a time point (the angle of rotation θ4) when the opening area of the movable vertical hole (71) with respect to the fixed communication groove (72) increases to the maximum.

When the orbiting scroll (35) once tilts as described above in these embodiments, the auxiliary introduction mechanism (80) then introduces the refrigerant of the compression chamber (31) into the middle-pressure back-pressure chamber (56). Specifically, suppose, for example, in the second period illustrated in FIG. 4, that the internal pressure of the compression chamber (31) is rising; whereas, the internal pressure of the middle-pressure hack-pressure chamber (56) is having a difficult time rising. Here, the pressure of the compression chamber (31) rises by a predetermined pressure than the pressure of the upper space (15), and the check valve (82) is opened. Then, in the second period, the refrigerant, of the compression chamber (31), in the middle of compression is supplied through the fixed communication hole (81) and the upper space (15) to the middle-pressure hack-pressure chamber (56). As a result, the pressure of the middle-pressure hack-pressure chamber (56) quickly rises.

After that, when the orbiting scroll (35) reaches the angle of rotation θ2, the introduction mechanism (70) supplies the refrigerant, of the compression chamber (31), in the middle of compression to the middle-pressure back-pressure chamber (56). Hence, when the orbiting scroll (35) tilts in these embodiments, the refrigerant of the compression chamber (31) is supplied to the middle-pressure back-pressure chamber (56) throughout the second period as well as the first period. Thus, compared with a configuration of a typical scroll compressor in which the refrigerant is sent to the middle-pressure back-pressure chamber (56) only in the first period, these embodiments allow the pressure of the middle-pressure back-pressure chamber to rise quickly.

Moreover, in these embodiments, FIG. 4 shows that a part of the second period overlaps with a part of the first period, and the second period ends at a time point almost immediately before the angle of rotation θ4. Such a feature allows a refrigerant under a relatively high pressure to be introduced for a long period from the auxiliary introduction passage (81) toward the middle-pressure back-pressure chamber (56). As a result, the pressure of the middle-pressure back-pressure chamber (56) may be raised more quickly.

Effects of Embodiments

According to the embodiments, even if the orbiting scroll (35) tilts when the compressor (10) starts to operate or changes operations, the auxiliary introduction mechanism (80) supplies the fluid of the compression chamber (31) to the middle-pressure back-pressure chamber (56) before the introduction mechanism (70) does. Such a feature contributes to a quick rise in the pressure of the middle-pressure back-pressure chamber (56). As a result, the tilt of the orbiting scroll (35) may be removed quickly, and the compressor (10) may return to the normal operation.

Moreover, according to these embodiments, a part of the second period overlaps with a part of the first period. Here, in the first period, the introduction mechanism (70) supplies the fluid to the middle-pressure back-pressure chamber (56), and, in the second period, the auxiliary introduction mechanism (80) supplies the fluid to the middle-pressure back-pressure chamber (56). Such an overlap allows for supplying, for a long time, the middle-pressure back-pressure chamber (56) with a fluid under a relatively high pressure. As a result, the tilt of the orbiting scroll (35) may be removed more quickly.

Furthermore, in the embodiments, the inflow end of the auxiliary introduction passage (81) of the auxiliary introduction mechanism (80) is located slightly closer to the low-pressure side (the suction side) than the inflow end of the introduction passages (71, 72) of the introduction mechanism (70) is. In the normal operation of the compressor (10), such a feature may reliably reduce a risk that the pressure of the middle-pressure back-pressure chamber (56) exceeds the target pressure obtained by the introduction mechanism (70).

Other Embodiments

The above embodiments may be implemented as described below.

According to the above embodiments, a part of the second period overlaps with a part of the first period. Here, in the second period, the auxiliary introduction mechanism (80) supplies the refrigerant to the middle-pressure back-pressure chamber (56), and, in the first period, the introduction mechanism (70) supplies the refrigerant to the middle-pressure back-pressure chamber (56). However, both of the periods do not necessarily have to overlap with each other. The first period may be set after the end of the second period.

Moreover, in the auxiliary introduction mechanism (80) according to these embodiments, the auxiliary introduction passage (81) is defined on the peripheral wall portion (43*a*) of the rim (43) of the fixed scroll (40). However, a through hole may be formed on the fixed end plate part (41) of the fixed scroll (40) to act as the auxiliary introduction passage (81). In this case, the check valve (82) is attached to an upper portion of the fixed end plate part (41) to open and close the upper end portion of the auxiliary introduction passage (81).

INDUSTRIAL APPLICABILITY

As can be seen, the present invention is useful for a scroll compressor and, in particular, as a counter measure to a tilt of an orbiting scroll.

What is claimed is:

1. A scroll compressor comprising:

a compression mechanism including a fixed scroll and an orbiting scroll, the fixed scroll and the orbiting scroll having a compression chamber defined therebetween, the compression mechanism further including an introduction mechanism having an introduction passage providing communication between the compression chamber and a back-pressure chamber, the introduction mechanism being configured to supply, throughout a first period, a fluid of the compression chamber to the back-pressure chamber on a back side of the orbiting scroll, and an auxiliary introduction mechanism having an auxiliary introduction passage providing communication between the compression chamber and the back-pressure chamber, and a check valve allowing the fluid to flow from the compression chamber to the back-pressure chamber, and blocking the fluid from flowing from the back-pressure chamber toward the compression chamber, the auxiliary introduction mechanism being configured to supply, throughout a second period, the fluid of the compression chamber to the back-pressure chamber, the second period including a time point prior to the first period, the introduction passage providing communication between the back-pressure chamber and an outermost compression chamber of the compression chamber, and the auxiliary introduction passage providing communication between the outermost compression chamber and the back-pressure chamber.

2. The scroll compressor of claim 1, wherein the auxiliary introduction mechanism is configured to overlap a part of the second period with a part of the first period.

3. The scroll compressor of claim 2, wherein in the compression chamber, an inflow end of the auxiliary introduction passage is opened closer, in a circumferential direction along an interior wall inside the fixed scroll, to a low-pressure side of the compression chamber than an inflow end of the introduction passage is.

4. The scroll compressor of claim 2, wherein the introduction passage includes a movable vertical hole penetrating a movable end plate part of the orbiting scroll and communicating with the back-pressure chamber, and a fixed communication groove defined on a rim of the fixed scroll and configured to communicate with the compression chamber, the fixed communication groove and the movable vertical hole intermittently communicating with each other with rotation of the orbiting scroll, and the auxiliary introduction mechanism is configured to finish the second period before an opening area of the movable vertical hole with respect to the fixed communication groove increases to a maximum.

5. The scroll compressor of one of claim 1, wherein in the compression chamber, an inflow end of the auxiliary introduction passage is opened closer, in a circumferential direction along an interior wall inside the fixed scroll, to a low-pressure side of the compression chamber than an inflow end of the introduction passage is.

6. The scroll compressor of claim 5, wherein the introduction passage includes a movable vertical hole penetrating a movable end plate part of the orbiting scroll and communicating with the back-pressure chamber, and a fixed communication groove defined on a rim of the fixed scroll and configured to communicate with the compression chamber, the fixed communication groove and the movable vertical hole intermittently communicating with each other with rotation of the orbiting scroll, and the auxiliary introduction mechanism is configured to finish the second period before an opening area of the movable vertical hole with respect to the fixed communication groove increases to a maximum.

7. The scroll compressor of claim 1, wherein the introduction passage includes a movable vertical hole penetrating a movable end plate part of the orbiting scroll and communicating with the back-pressure chamber, and a fixed communication groove defined on a rim of the fixed scroll and configured to communicate with the compression chamber, the fixed communication groove and the movable vertical hole intermittently communicating with each other with rotation of the orbiting scroll, and the auxiliary introduction mechanism is configured to finish the second period before an opening area of the movable vertical hole with respect to the fixed communication groove increases to a maximum.

* * * * *